US007392744B2

(12) United States Patent
Barrois et al.

(10) Patent No.: US 7,392,744 B2
(45) Date of Patent: Jul. 1, 2008

(54) DOCTOR BLADE DEVICE

(75) Inventors: Claus-Dieter Barrois, Erlenbach (DE); Thomas Hendle, Lausanne (CH); Johannes Georg Schaede, Würzburg (DE)

(73) Assignee: KBA-Giori S.A, Lausanne (CH)

( * ) Notice: Subject to any disclaimer, the term of this patent is extended or adjusted under 35 U.S.C. 154(b) by 279 days.

(21) Appl. No.: 10/554,809

(22) PCT Filed: May 4, 2004

(86) PCT No.: PCT/IB2004/001384

§ 371 (c)(1),
(2), (4) Date: Oct. 27, 2005

(87) PCT Pub. No.: WO2004/098891

PCT Pub. Date: Nov. 18, 2004

(65) Prior Publication Data

US 2006/0278110 A1 Dec. 14, 2006

(30) Foreign Application Priority Data

May 8, 2003 (DE) ..... 103 21 189

(51) Int. Cl.
*B41F 35/04* (2006.01)

(52) U.S. Cl. ..... 101/423; 101/425

(58) Field of Classification Search ..... 101/423–425, 101/483, 169, 167, DIG. 47
See application file for complete search history.

(56) References Cited

U.S. PATENT DOCUMENTS

| | | | | | |
|---|---|---|---|---|---|
| 2,022,635 | A | * | 11/1935 | Durham | 101/157 |
| 2,112,459 | A | * | 3/1938 | Friess | 101/157 |
| 3,279,367 | A | * | 10/1966 | Brown, Jr. | 101/150 |
| 3,749,014 | A | * | 7/1973 | Gates | 101/425 |
| 3,974,768 | A | * | 8/1976 | Grobman | 101/425 |
| 4,192,231 | A | | 3/1980 | Kawakami | |
| 5,103,732 | A | * | 4/1992 | Wells et al. | 101/480 |

FOREIGN PATENT DOCUMENTS

| | | | |
|---|---|---|---|
| DE | 199 31 001 | A | 1/2000 |
| EP | 1 132 211 | A | 9/2001 |

* cited by examiner

*Primary Examiner*—Anthony H. Nguyen
(74) *Attorney, Agent, or Firm*—Crompton, Seager & Tufte, LLC

(57) ABSTRACT

A doctor blade device (01) for cleaning a surface has a doctor blade (03) and a tub (09) for receiving the material stripped from the surface by the doctor blade. The doctor blade is movable between a position in which it projects out of an opening (13) of the tub and a position in which it is submerged in the tub. A closure element (07) closes the opening in the submerged position of the doctor blade.

10 Claims, 2 Drawing Sheets

Fig. 1
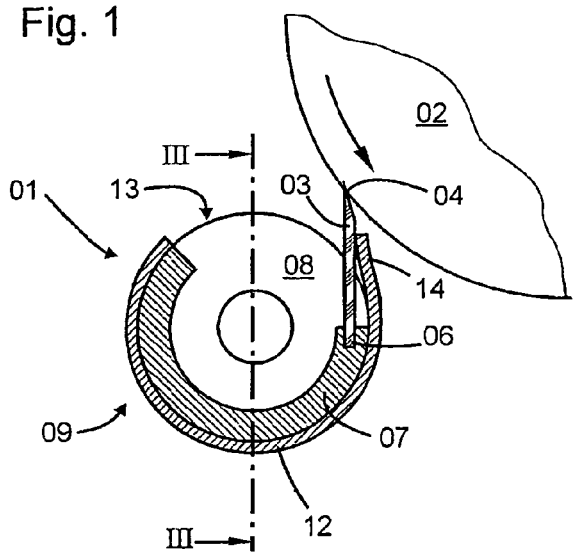
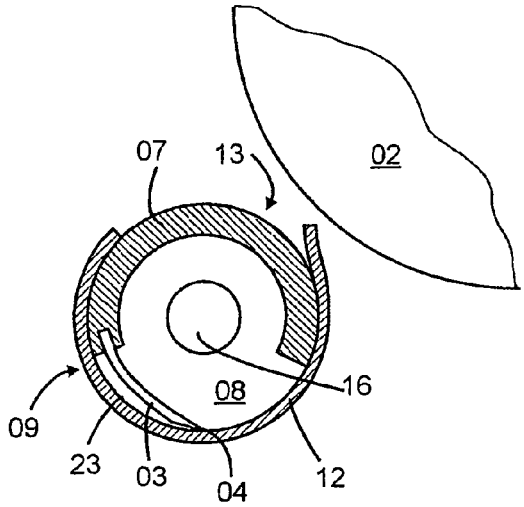
Fig. 2
Fig. 3
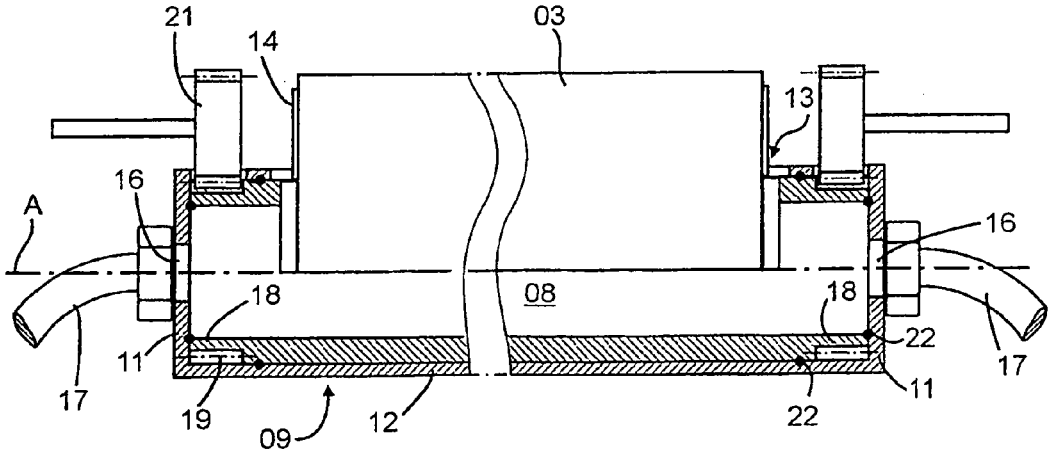

Fig. 4
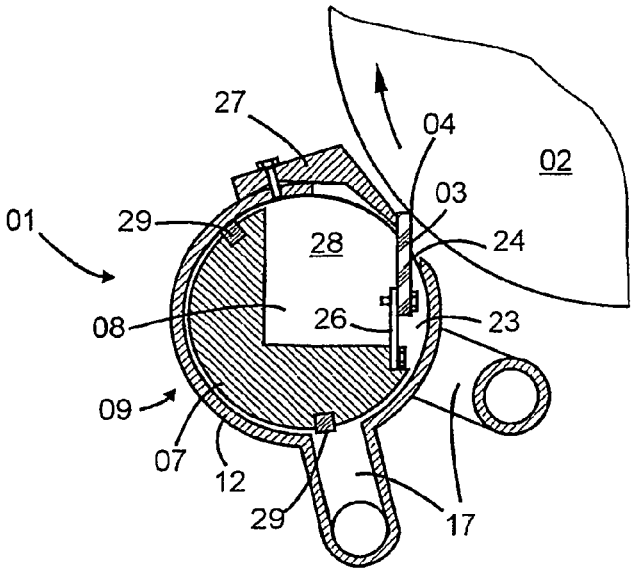
Fig. 5
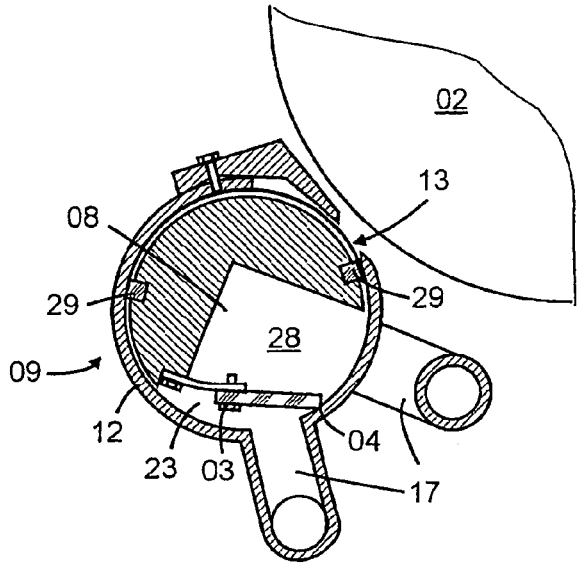
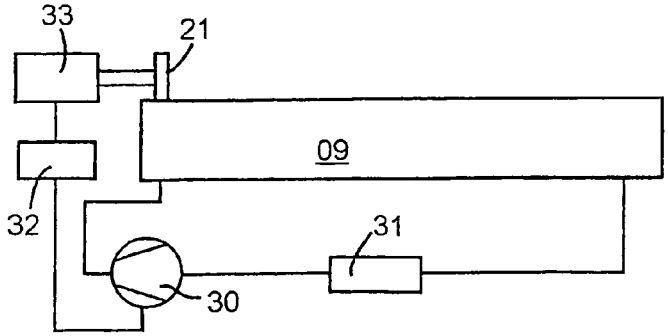
Fig. 6

DOCTOR BLADE DEVICE

FIELD OF THE INVENTION

The present invention relates to a doctor blade device.

BACKGROUND OF THE INVENTION

Washing apparatuses are known for the automatic cleaning of ink-carrying rolls in a printing press, which washing apparatuses comprise spray nozzles or similar means for applying a cleaning fluid to the surface which is to be cleaned, and also comprise a doctor blade device which serves for pressing a flexible doctor blade against the surface which is wetted with the washing fluid, and thus for wiping off the washing fluid together with ink which is dissolved in it. The ink solution which is obtained in this way runs off into a trough of the doctor blade device and is led away via the latter. After the end of the washing process, ink residues remain on a conventional doctor blade device of this type, which ink residues have to be removed by hand, as they would otherwise dry on the doctor blade and damage the surface of the roll to be cleaned when said doctor blade is used again.

The invention is based on the aim of providing a doctor blade device.

SUMMARY OF THE INVENTION

According to the invention, the object is achieved by a doctor blade device for cleaning a surface, having a doctor blade and a trough for receiving material which is wiped off from the surface by the doctor blade wherein the doctor blade can be moved between a position in which it protrudes from an opening in the trough and a position in which it is lowered into the trough, and in that the trough has a closure element which, in the lowered position of the doctor blade, is capable of closing the opening.

The advantages which can be attained with the invention consist, in particular, in the fact that it is possible to avoid ink drying and solidifying on the doctor blade when the latter is not in use, as a consequence of the capability to lower the doctor blade into the trough and to close the trough.

As the trough in general has an elongate shape with a slot-shaped opening for the emerging doctor blade, a possibility for closing the trough can be provided in a simple manner by the trough being configured in the shape of a cylindrical chamber, about the axis of which the closure element can rotate between an open and a closed position. Here, the closure element is preferably arranged within the chamber.

The movement of the doctor blade between the position which protrudes out of the trough and the lowered position is preferably a pivoting movement, and an actuator for driving this pivoting movement is provided on the doctor blade device.

The doctor blade is preferably deformed elastically in the lowered position.

A particularly simple construction results if the closure element can be pivoted by the same actuator which also drives the movement of the doctor blade between the position which protrudes out of the trough and the lowered position.

In order not only to prevent the drying of wiped off ink on the doctor blade but also, moreover, for it to be possible for wiped off ink residues to be removed automatically from the doctor blade, it is desirable for the trough to be provided with a feed line and a discharge line for a cleaning fluid. In the closed state of the trough, the cleaning fluid can be pumped through said trough at a high flow speed, in order to release and rinse away ink residues over time which adhere tenaciously to the doctor blade.

In order to attain an effective flow through the chamber, it is desirable for the feed line and the discharge line to open into in each case opposite ends of the trough.

The doctor blade device preferably also comprises a pump for circulating cleaning fluid through the trough. Expediently, this pump can be assigned a control apparatus which is coupled to the position of the closure element and, when the chamber is closed, permits a higher throughput of the pump than when the chamber is open. It is appropriate to allow a flow of cleaning fluid when the chamber is open, even if said flow is weak, in order continuously to rinse off ink residues which the doctor blade wipes off from the roll surface which is to be cleaned during operation of the doctor blade device. The throughflow rate when the chamber is open has to be selected to be low enough that cleaning fluid does not spray out of the opening of the chamber. In contrast, when the chamber is closed, substantially higher throughflow rates can be used advantageously for the cleaning fluid.

It is desirable for ecological and economical reasons for the cleaning fluid to circulate in a closed circuit. This circuit expediently has at least one filter element for separating ink residues out of the flow of the cleaning fluid.

Exemplary embodiments of the invention are shown in the drawings and will be described in greater detail in the following text.

BRIEF DESCRIPTION OF THE DRAWINGS

In the figures:

FIG. 1 shows a diagrammatic section through a first refinement of a doctor blade device, in which the doctor blade is extended out of the chamber;

FIG. 2 shows a diagrammatic section through the doctor blade device from FIG. 1, in which the doctor blade is lowered into the trough;

FIG. 3 shows an axial section along the line III-III from FIG. 1;

FIG. 4 shows a section, which is analogous to that of FIG. 1, through a second embodiment of the doctor blade device;

FIG. 5 shows a section through the doctor blade device according to a second embodiment, with a lowered doctor blade; and FIG. 6 shows a block diagram of the doctor blade device.

DETAILED DESCRIPTION OF THE PREFERRED EMBODIMENTS

FIG. 1 shows a diagrammatic section through a doctor blade device 01 with a doctor blade 03 which is set against an inking roll 02 of a printing press. The inking roll 02 is shown only as a detail, over a quarter of its circumference.

The doctor blade 03 is a strip which extends at least over the active axial width of the inking roll 02 and is composed of a flexible plastic or rubber material. In the extended position of the doctor blade 03 which is shown in FIG. 1, one longitudinal edge 04 of the doctor blade 03 is in contact with the surface of the inking roll 02.

An opposite longitudinal edge 06 of the doctor blade 03 is clamped in a closure element 07 in the shape of a cylinder sector, for example a holding element 07. The holding element 07 is accommodated rotatably in a cylindrical chamber 08 of a trough 09. As shown in FIG. 3, the trough 09 is composed of two end plates 11 which lie opposite one another and a cover 12 which connects the two end plates 11. The cover 12 has substantially the shape of a cylinder, with an elongate opening 13, for example a slot 13, on its upper side and an elongate tongue 14 which is bent outward at one end of the slot 13 and serves as a support 14 for the doctor blade 03 when the inking roll 02 is being wiped.

Both end plates 11 are provided with a hole 16, to which in each case a feed line or discharge line 17 for a cleaning fluid is connected.

When the inking roll 02 is being cleaned, a nozzle rail (not shown) sprays a cleaning fluid onto the entire width of the cover of the inking roll 02. The inking roll 02 rotates in the counterclockwise direction in relation to FIG. 1. The doctor blade 03 presses against the surface of the inking roll 02 at an acute angle. The friction which occurs here increases the pressure between the doctor blade 03 and the inking roll 02 and, moreover, presses the doctor blade 03 against the supporting tongue 14 of the trough 09. A mixture of cleaning fluid and ink residues which is moved over the surface of the inking roll 02 is wiped off by the doctor blade 03 and flows downward on the latter into the trough 09, where it is entrained by a flow of cleaning fluid which flows through the trough 09 in the longitudinal direction from the feed line to the discharge line 17. The throughput of the cleaning fluid in this state is measured to be just sufficient to ensure that the ink residues are rinsed away reliably and are not deposited in the trough 09. For this purpose, it is not necessary for the flow to fill the entire cross section of the trough 09.

After the inking roll 02 has been cleaned, the holding element 07 together with the doctor blade 03 is rotated about the longitudinal axis A of the chamber 08 into the position which is shown in FIG. 2. For this purpose, the holding element 07 merges at its two longitudinal ends into a cylindrical ring 18 which is closed in the circumferential direction and fills the inner cross section of the likewise cylindrical chamber 08 exactly. An external toothing system 19 which meshes with a pinion 21 is formed on each of these rings 18. The pinions 21 at both ends of the trough 09 are driven by an identical actuating motor (not shown). The external toothing systems 19 are protected in each case by sealing rings 22 against the infiltration of rinsing fluid and possibly ink.

FIG. 2 shows the doctor blade device 01 in a configuration, in which the holding element 07 with the doctor blade 03 is rotated in the clockwise direction by not quite 180° compared with the configuration of FIG. 1. Here, the doctor blade 03 is situated in a position which is withdrawn completely into the chamber 08. Instead of against the inking roll 02, the longitudinal edge 04 of the doctor blade 03 presses against the cover 12 of the trough 09, and the doctor blade 03 is bent elastically into itself. The holding element 07 blocks the slot 13, with the result that the holding element 07 and the cover 12 form a tube which is closed all around. In order to clean the doctor blade 03, cleaning fluid is pumped at high speed through the chamber 08 in this configuration of the doctor blade device 01. In contrast to the configuration of FIG. 1, where a uniform, laminar flow is required to prevent cleaning fluid from spraying out of the trough 09, a turbulent flow can be accepted here and is even desirable, in order to improve the cleaning action on the doctor blade 03. The flow through the chamber 08 can be maintained for as long as is necessary to clean the doctor blade 03 with a desired accuracy.

As can be seen in the cross section in FIG. 2, the withdrawn doctor blade 03 separates a small region 23 of the cross section of the chamber 08, which small region 23 does not communicate directly with the holes 16 on the end plates 11 of the trough 09 and in which small region 23 no significant flow of the cleaning fluid therefore occurs. However, this is insignificant for the efficacy of the cleaning of the doctor blade, as that lateral face of the doctor blade 03 which delimits the region 23 is not reached by the ink/cleaning fluid mixture when the mixture is being wiped off the inking roll 02 and remains clean. If it should prove necessary in an individual case also to clean that surface of the doctor blade 03 which faces the region 23, it is not a problem to generate a flow of cleaning fluid in this region also, for example by the position at least of the hole 16 which is connected to the feed line in its end plate 11 being displaced in such a way that at least part of its cross section opens into the region 23.

FIG. 4 shows a second embodiment of a doctor blade device 01 in an illustration which is analogous to FIG. 1. Identical elements which are present in both embodiments are denoted by identical designations and will not be described again. The doctor blade device 01 from FIG. 4 is designed for an inking roll 02 which rotates in the clockwise direction in the perspective of this figure. The doctor blade 03 is composed of a rigid doctor blade lip 24 made from plastic and a spring 26, for example a leaf spring 26 which, like the doctor blade lip 24, extends over the entire width of the inking roll 02. The leaf spring 26 is screwed on one side to the doctor blade lip 24 and on the other side to a holding element 07 which has the same functions as the holding element 07 from FIG. 1. The tongue 14 of the embodiment from FIG. 1 is replaced by a rail 27 which is screwed to the cover 12 and holds the free longitudinal edge 04 of the doctor blade 03 pressed against the inking roll 02. The rail 27 can be removed, in order to gain access to the interior of the trough 09 for maintenance and repair purposes.

The feed and discharge lines 17 for cleaning fluid are not guided through the end plates 11, but through the cover 12 of the trough 09 near the ends which lie opposite one another.

If the doctor blade 03 is situated in the withdrawn position which is shown in FIG. 5, it divides the free inner space of the chamber 08 into two regions 23, 28. The feed line 17 is arranged in such a way that it opens into the region 23 which is delimited by that lateral side of the doctor blade 03 which bears wiped-off ink in this embodiment. The discharge line 17 opens into the region 28. A flow of cleaning fluid which is pumped through the chamber 08 via the feed and discharge lines 17 rinses the chamber 08 not only in the longitudinal direction, but it also displaces the doctor blade 03 a little away from the cover 12 back into the interior of the chamber 08, with the result that a narrow gap is produced along the longitudinal edge 04 of the doctor blade 03, through which narrow gap the cleaning fluid moves at high speed from the region 23 into the region 28. In this way, highly effective cleaning is attained, above all of the longitudinal edge 04 which is provided for contact with the inking roll 02.

Two sealing strips 29 made from rubber are let into the body of the holding element 07 and rotate with the latter. They are placed in such a way that, in the closed configuration which is shown in FIG. 5, they come to rest on both sides of the slot 13 and prevent egress of the cleaning fluid toward the inking roll 02 reliably.

As the block diagram from FIG. 6 shows, the doctor blade device 01 also comprises a pump 30 which circulates the cleaning fluid in a closed circuit. The pump 30 is coupled to a control circuit 32 which also drives the actuating motor 33 for the pivoting movement of the holding element 07 and the doctor blade 03. Coupled to the respective position of the holding element 07, the control circuit 32 regulates the throughput of cleaning fluid to a low value in the open position and to a high value which favors a turbulent flow of cleaning fluid in the closed position. Furthermore, filters 31 for trapping ink residues which are dissolved in the cleaning fluid are arranged in the closed circuit, with the result that the doctor blade device 01 can be operated for a long time without maintenance.

We claim:

1. A doctor blade device for cleaning a surface, having a doctor blade and a trough for receiving material which is wiped off from the surface by the doctor blade, wherein the doctor blade is movable moved between a position in which it protrudes from an opening in the trough and a position in which it is lowered into the trough, wherein the trough has a closure element which, in the lowered position of the doctor blade, is capable of closing the opening, and wherein the trough has a cylindrical chamber, about a longitudinal axis of which the closure element is rotatable.

2. The doctor blade device as claimed in claim 1, wherein the closure element is arranged within the chamber.

3. The doctor blade device as claimed in claim 1, comprising an actuator for pivoting the doctor blade about the longitudinal axis of the chamber between the position which protrudes out of the trough and the lowered position.

4. The doctor blade device as claimed in claim 3, wherein the doctor blade is deformed elastically in the lowered position.

5. The doctor blade device as claimed in claim 4, wherein the closure element is pivoted by the actuator.

6. The doctor blade device as claimed in claim 1, wherein the trough is provided with a feed line and a discharge line for a cleaning fluid.

7. The doctor blade device as claimed in claim 6, wherein the feed line and the discharge line open into opposite end sections of the trough.

8. The doctor blade device as claimed in claim 6, comprising a pump for circulating cleaning fluid through the trough.

9. The doctor blade device as claimed in claim 8, further comprising a control circuit coupled to the position of the closure element for controlling a throughput of the pump, wherein, when the chamber is closed, the control circuit increases the throughput of the pump as compared to the throughput of the pump when the chamber is open.

10. The doctor blade device as claimed in claim 6, comprising a closed circuit for the cleaning fluid.

* * * * *

UNITED STATES PATENT AND TRADEMARK OFFICE

CERTIFICATE OF CORRECTION

PATENT NO. : 7,392,744 B2
APPLICATION NO. : 10/554809
DATED : July 1, 2008
INVENTOR(S) : Claus-Dieter Barrois, Thomas Hendle and Johannes Georg Schaede It is certified that error appears in the above-identified patent and that said Letters Patent is hereby corrected as shown below:

Column 5
Line 9, delete "moved"

Signed and Sealed this

Sixteenth Day of September, 2008

JON W. DUDAS
*Director of the United States Patent and Trademark Office*